US005584134A

United States Patent [19]

Chaput

[11] Patent Number: 5,584,134

[45] Date of Patent: Dec. 17, 1996

[54] FOLDABLE ASSEMBLY UNIT WITH DISPLAY OBJECT AND PEDESTAL

[76] Inventor: Rob Chaput, 3731 Ridge Rd., Smyrna, Ga. 30080

[21] Appl. No.: 509,697

[22] Filed: Jul. 31, 1995

[51] Int. Cl.[6] ..... G09F 1/08

[52] U.S. Cl. ..... 40/539; 40/124.1; 446/488

[58] Field of Search ..... 40/124.1, 539; 446/488, 387

[56] References Cited

U.S. PATENT DOCUMENTS

| | | | |
|---|---|---|---|
| 1,555,566 | 9/1925 | Furste | 40/124.1 |
| 1,622,020 | 3/1927 | Anderson | 40/124.1 |
| 2,064,434 | 12/1936 | Leigh | 40/539 |
| 2,113,406 | 4/1938 | Koeble | 40/124.1 |
| 2,441,333 | 5/1948 | Reinsberg | 40/539 |
| 3,575,285 | 1/1969 | Kahn . | |
| 3,727,874 | 4/1973 | Wuensch . | |
| 3,917,073 | 11/1975 | Kulkey . | |
| 3,963,121 | 6/1976 | Kipp . | |
| 3,970,332 | 7/1976 | Alford . | |
| 4,055,690 | 10/1977 | Patterson | 40/124.1 X |
| 4,736,537 | 4/1988 | Sheffer . | |
| 4,938,343 | 7/1990 | Willis . | |
| 4,958,671 | 9/1990 | Bove . | |
| 5,067,543 | 11/1991 | Bove . | |
| 5,273,169 | 12/1993 | Maglione . | |
| 5,289,650 | 3/1994 | Follet et al. . | |
| 5,366,100 | 11/1994 | Maglione . | |
| 5,402,378 | 4/1995 | Carr et al. . | |
| 5,417,431 | 5/1995 | Gluck . | |

*Primary Examiner*—Brian K. Green
*Attorney, Agent, or Firm*—Alfred Walker

[57] ABSTRACT

A point of sale advertising display is assembled from a flat shipping state to a three dimensional assembly. The display assembly folds together from a flat state to a three dimensional state, and utilizes the surfaces of the substrates so formed to portray advertising messages. The advertising messages are related to the actual shape of the object being advertised, such as a beverage bottle, and creates an illusion of three dimensional depth, by portraying the erect object within a hollow pedestal structure, wherein the recess between the peripheral edge of the structure and the erect object creates a visual effect of depth. The space enables a shadow to exist within the space of the pedestal structure and to portray an enhanced three dimensional effect. To further enhance the attention of the point of sale purchaser, the pedestal structure itself is cylindrical, to give the advertising patron a illusion of holding a cylindrical bottle, by providing a round cylindrical pedestal structure to manually grasp at the point of sale advertising environment, such as at a restaurant table.

9 Claims, 3 Drawing Sheets

FOLDABLE ASSEMBLY UNIT WITH DISPLAY OBJECT AND PEDESTAL

FIELD OF THE INVENTION

The present invention relates to a foldable assembly unit for point of sale advertising purpose, wherein a display object is portrayed exposed above a pedestal-base.

BACKGROUND OF THE INVENTION

Various attempts have been to provide point of sale advertising displays which can be assembled from a flat shipping state to a three dimensional assembly when the various parts are interconnected and bent along folded pleats.

While there are a number of display assemblies which fold together from a flat-state to a three dimensional state, these prior art devices utilize the surfaces of the substrates thus formed to portray advertising messages.

For example, a crown shaped hat formed from a panel curved about itself, and attached by a tab within a slot at one end thereof, may have a logo of a fast food restaurant on an outside surface of the cylindrical crown, or a pictorial image of the food sold thereat, but the crown shaped hat does not have a die-cut image of a product sought to be advertised, wherein the image rises up from inside a space within the cylindrical hat thus formed, so that a recess is provided between the object being portrayed and the rounded crown shaped hat, for enhancing the visual effect of depth.

In such an advertising display, the advertising messages themselves are independent of the actual shape of the object being advertised.

OBJECTS OF THE INVENTION

It is therefore an object of the present invention to provide an attractive foldable assembly display unit for point of sale advertising.

It is yet another object to provide a point of sale display assembly wherein a consumer product, such as a beverage bottle, is portrayed exposed above pedestal base.

It is yet another object to provide a point of sale advertising display which can be assembled from a flat shipping state to a three dimensional assembly wherein the various parts are interconnected and bent along folded pleats.

It is a further object to provide a point of sale display assembly which contains visually observable surfaces to portray advertising messages.

It is yet another object to provide a point of sale display assembly which displays advertising messages which contains the actual shape of the object being advertised.

It is yet another object to portray an actual sample of an erect object, such as a beverage bottle, in an illusion of three dimensions.

It is yet a further object to provide a point of sale display assembly which creates an illusion of three dimensional depth by portraying the erect object within a hollow pedestal structure, wherein the recess between the peripheral edge of the structure and the erect object creates a visual effect of depth.

It is yet another object to provide a momentary optical illusion which tricks the eye into thinking momentarily that the flat erect object, such as a portrayal of a beverage bottle, is in reality a three dimensional bottle.

It is yet a further object to provide a point of sale display assembly which provides a pedestal structure which itself is cylindrical, to give the advertising patron a illusion of holding a cylindrical bottle, by providing a round cylindrical pedestal structure to manually grasp in the point of sale advertising environment, such as at a restaurant table.

It is yet a further object to provide a point of sale display assembly which provides a space between the erect panel portraying the simulated beverage bottle and the edge of the pedestal structure to further enhance a three dimensional illusion, wherein the space enables a shadow to exist within the confines of the pedestal structure, to portray an enhanced three dimensional effect.

It is yet another object to provide a display assembly which includes a brace attached by a foldable pleat to a flat pedestal panel portion, which flat pedestal panel portion folds curvilinearly and arcuately around the plate brace to fold into a cylindrical configuration.

It is yet another object to provide a display assembly which includes an assembly which is held together by tabs insertable within slots within the pedestal panel portion of the display assembly.

It is yet another object to improve over the disadvantages of the prior art.

SUMMARY OF THE INVENTION

In keeping with these and other objects which may become apparent, the present invention is directed to a point of sale advertising display which can be assembled from a flat shipping state to a three dimensional assembly, wherein the various parts are interconnected and bent along folded pleats.

The display assembly folds together from a flat state to a three dimensional state, and utilizes the surfaces of the substrates so formed to portray advertising messages.

The advertising messages is related to the actual shape of the object being advertised. For example, the foldable assembly of the present invention portrays an actual sample of an erect object, such as a beverage bottle, and creates an illusion of three dimensional depth, by portraying the erect object within a hollow pedestal structure, wherein the recess between the peripheral edge of the structure and the erect object creates a visual effect of depth. This visual effect of depth tricks the eye into thinking momentarily that the flat erect object, such as a portrayal of a beverage bottle, is in reality a three dimensional bottle.

To further enhance the attention of the point of sale purchaser, the pedestal structure itself is cylindrical, to give the advertising patron a illusion of holding a cylindrical bottle, by providing a round cylindrical pedestal structure to manually grasp at the point of sale advertising environment, such as at a restaurant table.

The erect object, such as an erect panel simulating a beverage bottle, is accommodated within the pedestal structure, so that a small portion of the simulated beverage bottle is below the surface of the edge of the pedestal structure. Therefore, an illusion of depth is created with relation to the top of the pedestal structure, and a space is provided between the erect panel portraying the simulated beverage bottle and the edge of the pedestal structure to further enhance the three dimensional illusion. The space enables a shadow to exist within the space of the pedestal structure and to portray an enhanced three dimensional effect.

The erect panel is attached by means of a novel bent fastener brace, which includes a plate brace attached by a foldable pleat to a flat pedestal panel portion, which folds curvilinearly and arcuately around the plate brace to fold into a cylindrical configuration.

The assembly is held together by a first tab insertable within a first slot within the pedestal panel portion and a second tab insertable within a second slot within the pedestal panel portion.

The thus formed substantially cylindrical pedestal base portion contains two substantially hemispherical arcuate portions.

One first arcuate portion of the substantially cylindrical pedestal base portion extends from the first folded pleat to a point along the arcuate length of the pedestal panel portion to where the further slot intersects the pedestal panel portion for insertion of the further fastener tab, which tab extends from a side edge of the base brace portion, which side edge is opposite to the edge constituting the foldable pleat from which the pedestal panel extends.

The second arcuate portion extends from the point where the further slot intersects the pedestal panel portion for insertion of the further fastener tab extending from a side edge of the base brace portion, to the end of the pedestal panel. The first fastener tab thereat is inserted within the first slot, which said first slot located on the opposite end of the pedestal panel portion near the folded pleat.

To help maintain the substantially cylindrical shape of the pedestal structure, the base brace extends from the foldable pleat to an opposite edge having the further tab which intersects the further slot at a median point along the arcuate surface of the pedestal panel in its curved assembled state.

To maintain the structural integrity of the erect object being displayed, such as a beverage bottle, the erect object portion is formed by two adjacent panels joined at a top folded pleat, in the vicinity of where the cap of the beverage bottle is portrayed. The two adjacent panels are attached to the base brace portion, which also preferably constitutes two adjacent panels for structural integrity.

One of the panels of the base brace portion extends to form the pedestal panel. The second panel of the base brace portion has an optional tear-off instructional panel with indicia directions for assembling the three dimensional display assembly from its flat transportable state. The tear off instructional panel is connected by a scored line to facilitate the easy tearing of the instructional panel from the respective panel of the base brace portion of the display assembly of the present invention.

The display assembly is constructed from a generally flat bendable material such as preferably card stock, but other materials such as poster board or cardboard may be utilized in the construction of the foldable display assembly.

The display assembly is preferably a product of die cut printing, wherein the outline of the erect object, such as the portrayed beverage bottle, is die cut so as to be a two-dimensional facsimile of an actual three-dimensional object, such as the actual beverage bottle to be portrayed.

The foldable display assembly includes at least one body of card stock having a thickness of at least one ply. An image of an object sought to be advertised, such as a beverage bottle, is attached to and extends above the base brace, wherein the image of the bottle is imprinted on the card stock extending above the base brace.

The aforementioned pedestal portion preferably comprises an elongated strip of card stock which is integral with the base brace portion substantially along the folded pleat noted above. The first slot is located substantially near in an axial direction parallel to the pleat, and the first tab insertable within the first slot is located substantially at an end of the elongated strip of card stock constituting the pedestal portion. The second, further tab is located substantially at an edge of the base brace portion, which edge is substantially parallel to and opposite to the folded pleat, and the second tab is insertable within the second, further slot noted above, which second slot is situated substantially midway between the end of the elongated pedestal strip of card stock and the first foldable pleat.

When these tabs are inserted within their respective slots, the pedestal portion is curved into a substantially cylindrical shape which is substantially bisected and reinforced by the aforesaid base brace portion.

The pedestal portion is then positioned as a pedestal base structure around the base brace portion, supporting the upright positioning of the image of the object, such as a beverage bottle, upon the placement of lower edging of the pedestal portion in an interfacing position with a substantially flat surface, such as a point of sale tabletop.

The pedestal portion may contain promotional indicia providing point of sale information regarding a product represented by the image of the object, such as a bottle of a consumable product, such as a beverage, which may be a liquid such as bottled water, a carbonated beverage, an energy drink, an alcoholic beverage or spring water.

DESCRIPTION OF THE DRAWINGS

The present invention may be best understood in conjunction with the accompanying drawings in which.

DETAILED DESCRIPTION OF THE PREFERRED EMBODIMENT

Figure 1:
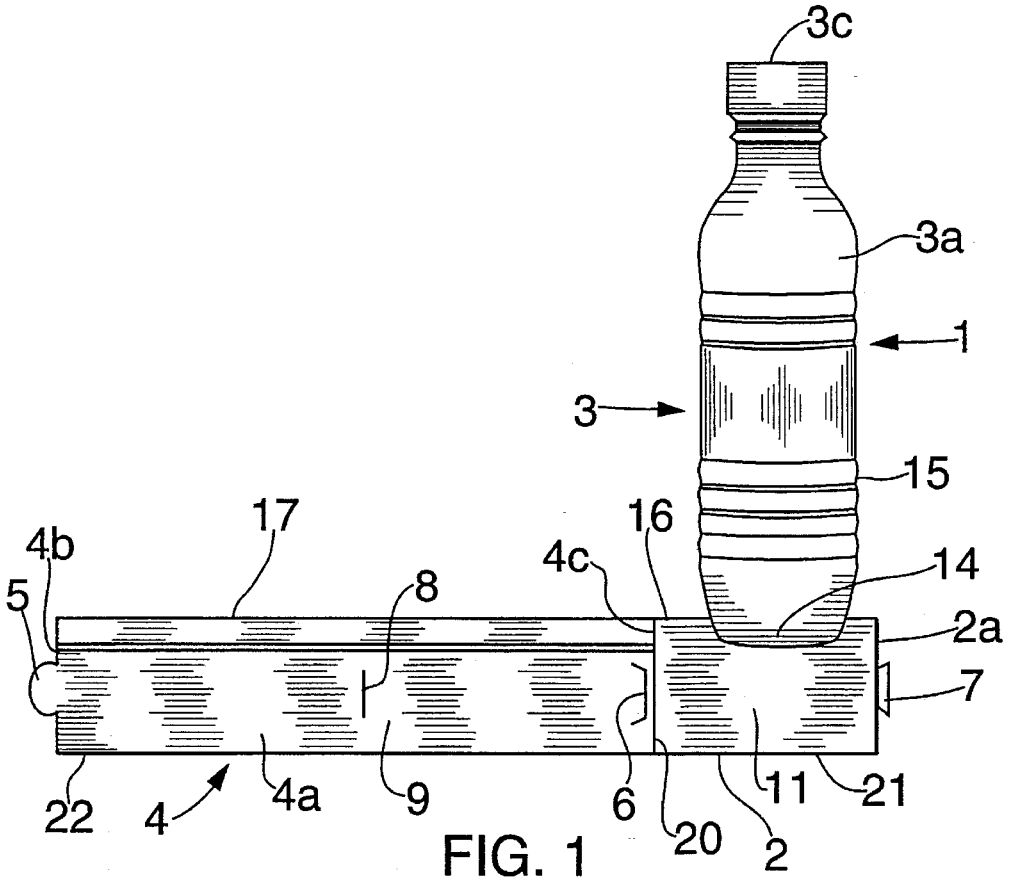
FIG. 1 is a front elevational view of the display assembly of the present invention.

Reference to be made to the drawing figures, wherein the drawings will be designated with like numerals throughout.

Figure 2:
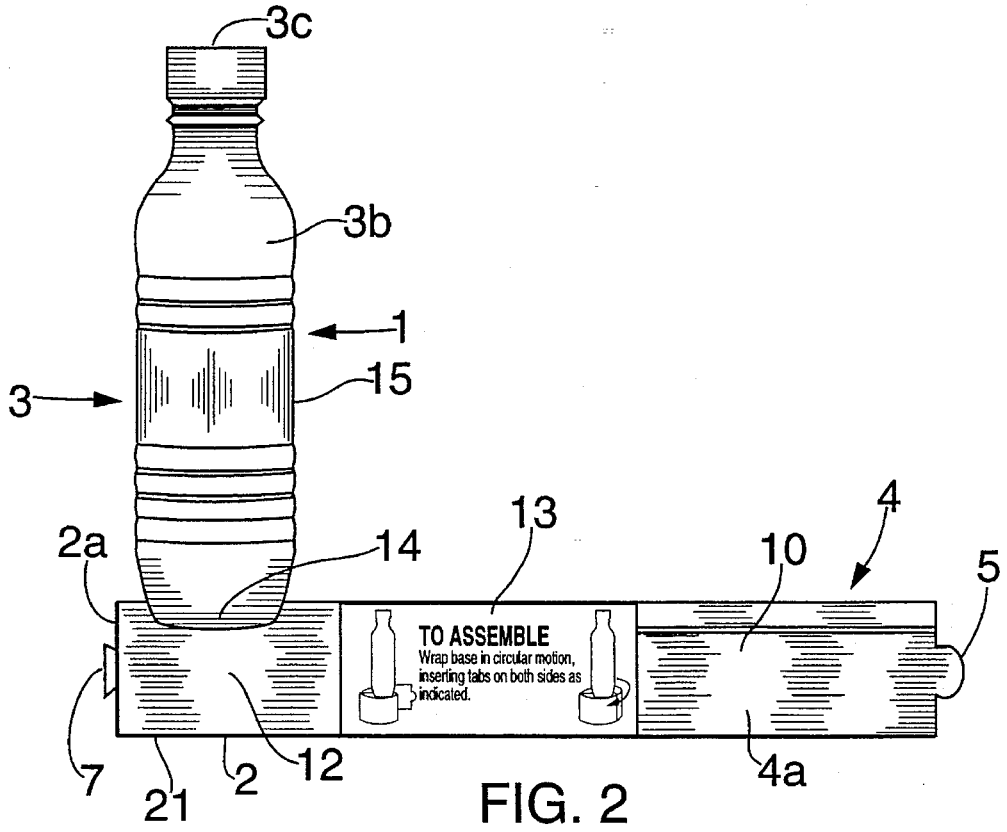
FIG. 2 is a rear elevational view of the display assembly as in FIG. 1.
Figure 3:
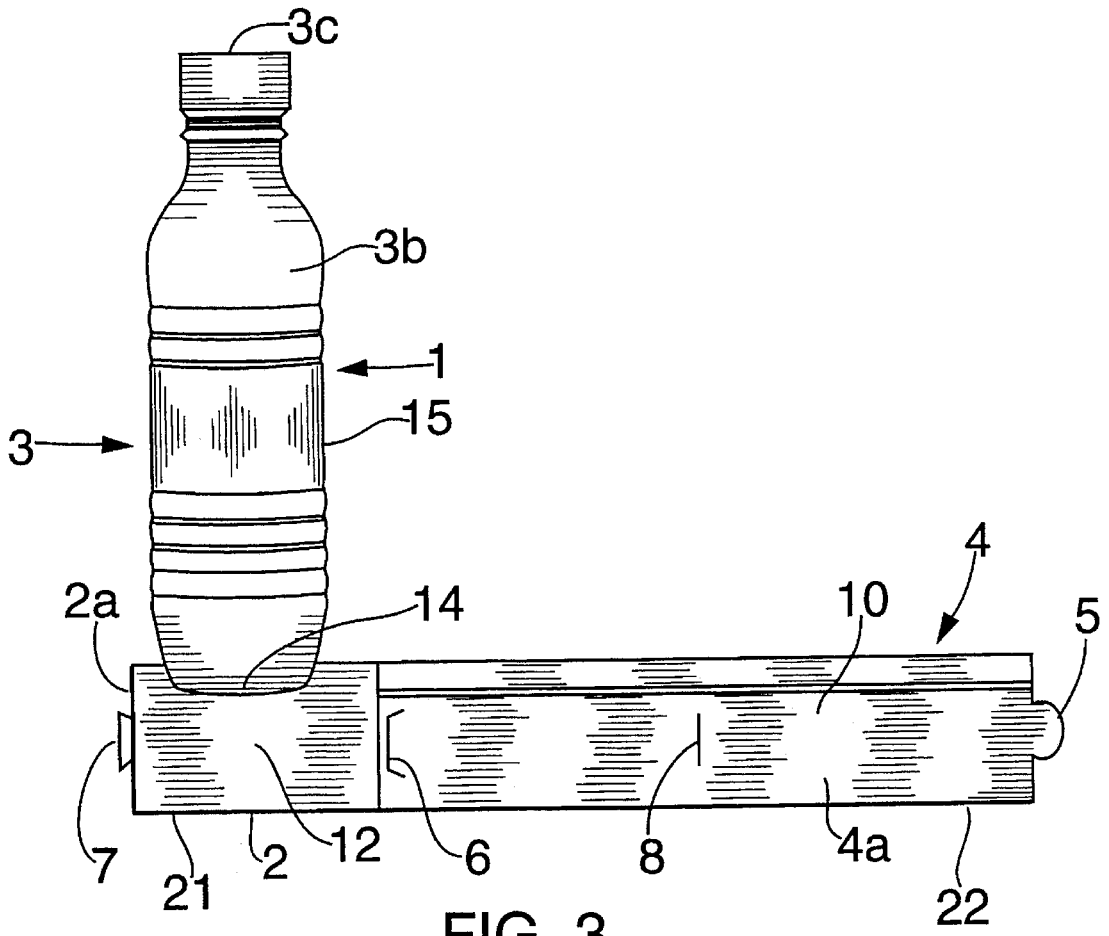
FIG. 3 is a rear elevational view of the display assembly as in FIG. 1, with a tear off instructional panel removed therefrom.
Figure 7:
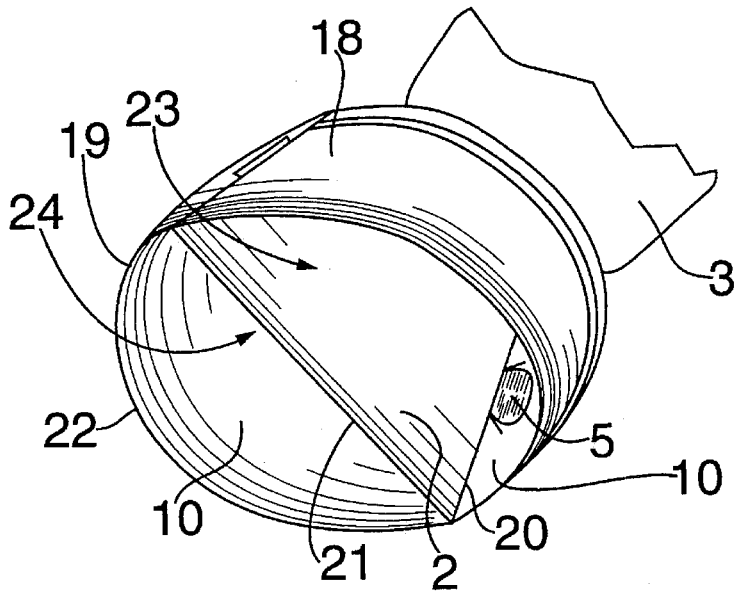
Figure 4:
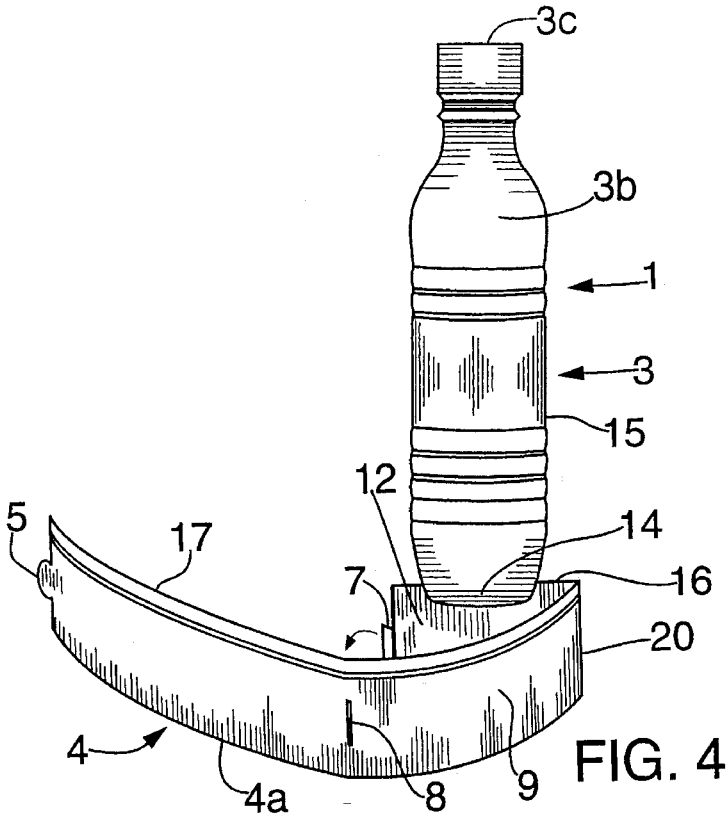
FIG. 4 is a rear perspective view of the display assembly as in FIG. 1, shown in a partially assembled state.
Figure 5:
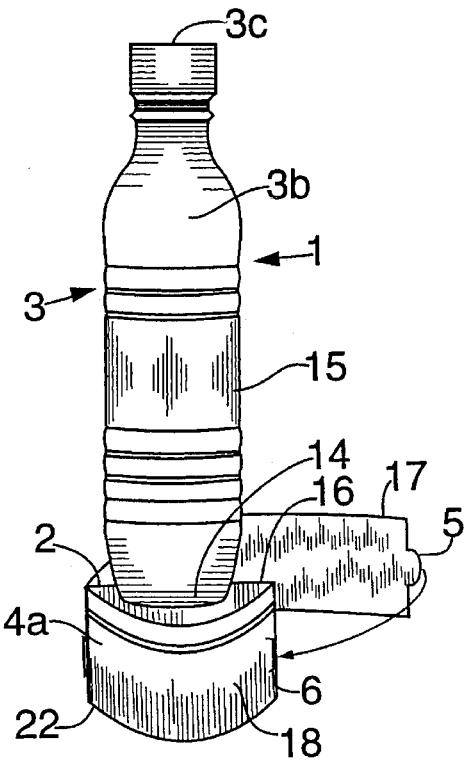
FIG. 5 is a rear perspective view of the display assembly as in FIG. 1, shown in a partially assembled state, shown in a further advanced assembled state.
Figure 6:
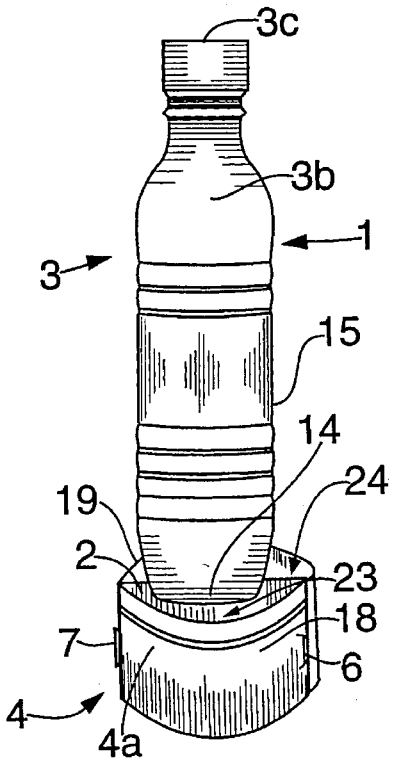
FIG. 6 is a rear perspective view of the display assembly as in FIG. 1, shown in a completed assembled state; and, FIG. 7 is a bottom perspective view showing the display assembly as in FIG. 1, shown in a completed assembled state.

As shown in FIGS. 1–7, a point of sale advertising display 1 is assembled from a flat shipping state shown in FIGS. 1 and 2 to a three dimensional assemble state, as shown in FIGS. 6 and 7.

As shown in FIGS. 1–7, foldable assembly 1 of the present invention portrays a facsimile of an actual sample imprinted as an image upon a body of sheet material, such as erect object 3, such as a beverage bottle, and creates an illusion of three dimensional depth, by portraying erect object 3 within hollow pedestal structure 4, wherein recesses 23, 24 between peripheral edge 17 of pedestal structure 4 and erect object 3 creates a visual effect of depth, which visual effect of depth tricks a user's eye into thinking momentarily that flat erect object 3, such as a portrayal of a beverage bottle, is in reality a three dimensional bottle.

To further enhance the attention of the user, such as a point of sale purchaser, pedestal structure 4 is cylindrical in its assembled state, to give the user a illusion of holding a cylindrical bottle, wherein round cylindrical pedestal structure 4 is manually grasped by the user at the point of sale advertising environment, such as at a restaurant table top.

While erect object 3 may be formed from a single panel of card stock, preferably erect object 3 is formed from two front and rear wall panels 3*a*, 3*b* respectively, which front and rear wall panels 3*a*, 3*b* are joined by a horizontally oriented top pleat 3*c* which is folded about itself so that front and rear wall panels 3*a*, 3*b* are joined adjacent inside edges thereof.

Erect object 3 preferably simulating a beverage bottle, and erect object 3 is accommodated within pedestal structure 4, so that a small portion 14 of the simulated beverage bottle of erect object 3 is below top edge surface 17 of pedestal structure 4 and a larger portion 15 of the simulated beverage bottle of erect object 3 is exposed above top edge 16 of base brace 2 and top edge surface 17 of pedestal structure 4.

As a result, an illusion of depth is created with relation to the top edge surface 17 of pedestal structure 4, and recess spaces 23, 24 are provided between erect object 3 portraying the simulated beverage bottle and edge 17 of pedestal structure 4, to further enhance the three dimensional illusion. Therefore, erect object 3 is spaced apart from edge 17 of pedestal structure 4.

Recesses 23, 24 provide spaces which enable shadows to exist within recesses 23, 24 of pedestal structure 4 to enhance a three dimensional effect of display assembly 1.

Erect object 3 is attached to fastener base brace 2, which base brace 2 is attached by vertically oriented foldable pleat 20 to flat pedestal panel portion 4*a* of pedestal 4, which flat pedestal panel portion 4*a* folds curvilinearly and arcuately around base brace 2 to fold into a cylindrical configuration constituting pedestal structure 4.

Flat pedestal panel portion 4*a* has two opposite-planar sides 9, 10, wherein side 9 is an outer side and side 10 is an inner side, when pedestal panel 4*a* is assembled in a cylindrical fashion, as shown in FIGS. 6 and 7.

Display assembly 1 is held together by attachment means, such as first tab 5 insertable within first slot 6 within pedestal panel portion 4*a* and further second tab 7 insertable within further second slot 8 within pedestal panel portion 4*a*.

The thus formed substantially cylindrical pedestal structure 4 includes two substantially hemispherical arcuate segments 18, 19.

One first arcuate segment 18 of substantially cylindrical pedestal structure 4 extends from first folded pleat 20 to a point along the arcuate length of pedestal panel portion 4*a* to where further second slot 8 intersects pedestal panel portion 4*a* for insertion of further second tab 7 therein. Tab 7 extends from a side edge of base brace 2*a*, which side edge 2*a* is opposite to the edge constituting vertically oriented foldable pleat 20 from which pedestal panel portion 4*a* extends.

Second arcuate portion 19 extends from the point where further second slot 8 intersects pedestal panel portion 4*a*, for insertion of further fastener tab 7 extending from side edge 2*a* of base brace 2, to end edge 4*b* of pedestal panel portion 4*a*. First fastener tab 5 thereat is inserted within first slot 6, which said first slot 6 is located on opposite end 4*c* of pedestal panel portion 4*a* near vertically oriented foldable pleat 20.

To maintain the substantially cylindrical shape of pedestal structure 4, base brace 2 extends from foldable pleat 20 to opposite edge 2*a*, which further tab 7 intersects further slot 8 at a median point along the arcuate surface of pedestal panel portion 4*a* in its curved assembled state as pedestal structure 4.

To maintain the structural integrity of erect object 3 being displayed, such as a beverage bottle, erect object 3 is formed by two adjacent panels 3*a*, 3*b* joined at top horizontally folded pleat 3*c*, in the vicinity of where the cap of the beverage bottle is portrayed. Adjacent panels 3*a*, 3*b* are attached to base brace 2, which base brace 2 also preferably constitutes two adjacent wall panels 11, 12 for structural integrity.

One panel 11 of the panels 11, 12 of base brace 2 extends to form pedestal panel portion 4*a*. Second panel 12 of base brace 2 has an optional tear-off instructional panel 13 with indicia directions for assembling display assembly 1 into a three dimensional state from its flat transportable state. Tear off instructional panel 13 is connected by a scored line to facilitate the easy tearing of instructional panel 13 from respective panel 12 of base brace 2 of display assembly 1 of the present invention.

Display assembly 1 is constructed from a generally flat bendable material such as card stock, poster board or cardboard. Display assembly 1 is preferably a product of die cut printing, wherein the outline of erect object 3, such as the portrayed beverage bottle, is die cut so as to be a two-dimensional facsimile of an actual three-dimensional object, such as the actual beverage bottle to be portrayed.

Foldable display assembly 1 includes at least one body of card stock having a thickness of at least one ply. An image upon erect object 3 sought to be advertised, such as a beverage bottle, is attached to and extends above base brace 2, wherein the image of the bottle is imprinted on the card stock of erect object 3 extending above base brace 2.

The aforementioned pedestal panel portion 4*a* preferably comprises an elongated strip of card stock which pedestal panel portion 4*a* is integral with base brace 2 substantially along vertically oriented foldable pleat 20 noted above.

First slot 6 is located substantially near in an axial direction parallel to foldable pleat 20, and first tab 5 is insertable within first slot 6 and first tab 5 is located substantially at end edge 4*b* of the elongated strip of card stock constituting pedestal panel portion 4*a*.

Second, further tab 7 is located substantially at edge 2*a* of base brace 2, which edge 2*a* is substantially parallel to and opposite to vertically oriented folded pleat 20, and second further tab 7 is insertable within second, further slot 8 noted above, which second slot 8 is situated substantially midway between end edge 4*b* of elongated strip of card stock constituting pedestal panel portion 4*a* and vertically oriented foldable pleat 20.

When tabs 5,7 are inserted within their respective slots 6,8, pedestal panel portion 4*a* is curved into a substantially cylindrical shape of pedestal structure 4, which pedestal structure 4 is substantially bisected and reinforced by base brace 2.

Pedestal panel portion 4*a* is then positioned as pedestal base structure 4 around base brace 2, supporting the upright positioning of erect object 3 having the image, such as a beverage bottle, upon the placement of lower edging 22 of pedestal panel portion 4*a* and lower edging 21 of base brace 2 in an interfacing position with a substantially flat surface, such as a point of sale tabletop.

Pedestal structure 4 may contain promotional indicia providing point of sale information regarding a product represented by the image of erect object 3, such as a bottle of a consumable product, such as a beverage.

The invention described herein may be embodied in other specific forms without departing from the spirit and scope of the present invention. The present embodiment is described in all respects only illustrative, and is not restrictive. The scope of the invention is therefore indicated by the appended claims rather then by the forgoing description. Any changes which come within the meaning of the scope of the claims are to be embraced within their scope.

I claim:

1. A foldable assembly unit comprising: an image of an object printed on at least one erect object portion of a body of card stock, said card stock having a thickness of at least one ply;

said erect object portion containing said image of an object, said erect object portion attached to and extending above a brace portion of a card stock;

a pedestal portion comprising an elongated strip of card stock which is integral with said brace portion substantially along a first pleat;

a first slot, said first slot being located substantially along said first pleat;

a first tab, said first tab being located substantially at an end of said elongated strip of card stock, said first tab being insertable into said first slot;

a second slot, said second slot being located substantially midway between said end of said elongated strip of card stock and said first pleat;

a second tab, said second tab being located substantially on an edge of said brace portion, said edge of said brace portion being substantially parallel to and opposite said first pleat, said second tab being insertable into said second slot;

said first tab being insertable into said first slot and said second tab being insertable into said second slot so as to position said pedestal portion as a pedestal base structure around said brace portion and supporting upright positioning of said erect object portion containing said image of said object upon placement of a lower edging of said pedestal portion in an interfacing position with a substantially flat surface.

2. The foldable assembly unit as claimed in claim 1, further comprising: a flap attached to said brace portion, said flap having imprinted thereon informational indicia.

3. The foldable assembly unit as claimed in claim 1, further comprising said pedestal portion bearing instructional indicia.

4. The foldable assembly unit as claimed in claim 1, wherein said brace portion and said erect object portion of said card stock extending above said brace portion substantially and mutually comprise a unit of card stock having at least two plys, and wherein said erect object portion containing said image of an object extends at least partially onto said brace portion.

5. The foldable assembly unit as claimed in claim 1, wherein said erect object portion is die cut substantially along the perimeter of said image of said object.

6. The foldable assembly unit as claimed in claim 5, wherein said image of said object is an image of a bottle containing a consumable liquid.

7. The foldable assembly unit as claimed in claim 1, wherein said image of said object is printed on two sides of said erect object portion of said card stock extending above said brace portion.

8. The foldable assembly unit as claimed in claim 1, wherein said pedestal portion comprises promotional indicia providing information on a product represented by said image of said object.

9. The foldable assembly unit as claimed in claim 1, wherein inserting said first tab into said first slot and said second tab into said second slot results in said pedestal portion forming a substantially cylindrical member substantially bisected by said brace portion.

* * * * *